US007655215B2

(12) United States Patent
Klepper

(10) Patent No.: US 7,655,215 B2
(45) Date of Patent: Feb. 2, 2010

(54) METHOD AND APPARATUS FOR PRODUCING SYNTHESIS GAS FROM WASTE MATERIALS

(75) Inventor: Robert E. Klepper, Arvada, CO (US)

(73) Assignee: Bioconversion Technology LLC, Denver, CO (US)

( * ) Notice: Subject to any disclaimer, the term of this patent is extended or adjusted under 35 U.S.C. 154(b) by 0 days.

(21) Appl. No.: 11/368,820

(22) Filed: Mar. 6, 2006

(65) Prior Publication Data

US 2007/0205092 A1 Sep. 6, 2007

(51) Int. Cl.
*C01B 3/24* (2006.01)
*C01B 31/18* (2006.01)
*C10J 1/28* (2006.01)

(52) U.S. Cl. ..... 423/650; 423/418.2; 48/197 R

(58) Field of Classification Search ..... 423/650, 423/418.2; 48/197 R
See application file for complete search history.

(56) References Cited

U.S. PATENT DOCUMENTS

| | | | |
|---|---|---|---|
| 2,772,954 A | 12/1956 | Jequier | |
| 3,971,639 A | 7/1976 | Matthews | |
| 4,017,272 A | 4/1977 | Anwer et al. | |
| 4,298,453 A | 11/1981 | Schoennagel et al. | |
| 4,591,362 A | 5/1986 | Yudovich et al. | |
| 5,695,532 A | 12/1997 | Johnson et al. | |
| 6,155,751 A | 12/2000 | Lane et al. | |
| 6,863,878 B2 | 3/2006 | Klepper | |
| 2003/0008928 A1 * | 1/2003 | Klepper | 518/704 |

FOREIGN PATENT DOCUMENTS

| | | |
|---|---|---|
| DE | 972345 | 7/1959 |
| DE | 43 25 029 A1 | 3/1994 |
| EP | 0067580 A1 | 12/1982 |
| EP | 1 048 710 A1 | 11/2000 |
| FR | 2390495 A1 | 12/1978 |
| FR | 2 863 920 A1 | 6/2005 |
| GB | 357424 | 9/1931 |
| GB | 2068014 A | 8/1981 |
| WO | 01/05910 A1 | 1/2001 |
| WO | 01/27222 A1 | 4/2001 |
| WO | 03/012013 A1 | 2/2003 |
| WO | 2004/074409 A1 | 9/2004 |

OTHER PUBLICATIONS

International Search Report, mailed Sep. 5, 2007.
International Search Report and Written Opinion of the International Searching Authority (2nd), PCT/US2007/063138, mailed Dec. 6, 2007.

* cited by examiner

*Primary Examiner*—Jafar Parsa
(74) *Attorney, Agent, or Firm*—Wood, Herron & Evans, L.L.P.

(57) ABSTRACT

An apparatus designed to form syn gas from carbonaceous materials such as coal includes a devolatilization reactor in combination with a reformer reactor which subsequently forms syn gas. The reformer reactor, in turn, is in communication with a particulate separator. The devolatilization reactor is fed with material using a compression feeder which drives air from the feed material, compresses it in a feed zone forming a seal between the feed hopper and the devolatilization reactor. The reformer reactor, as well as the particulate separators, are maintained in a heated furnace so that the temperature of the formed syn gas does not decrease below the reaction temperature until particulate material has been separated.

17 Claims, 4 Drawing Sheets

METHOD AND APPARATUS FOR PRODUCING SYNTHESIS GAS FROM WASTE MATERIALS

BACKGROUND OF THE INVENTION

Carbonaceous material can be reacted with steam at elevated temperatures to form syn gas, which is a combination of carbon monoxide and hydrogen. As disclosed in U.S. Pat. No. 6,863,878, if the initial reaction reaches a temperature greater than about 450° F. before the available oxygen is reacted, combustion occurs. This produces unwanted carbon dioxide, ash and slag. To avoid this, as disclosed in U.S. Pat. No. 6,863,878, the temperature must be maintained at 450° F. until after the available oxygen is reacted.

SUMMARY OF THE INVENTION

The present invention is premised on the realization that syn gas can be produced more efficiently by modifying the process disclosed in U.S. Pat. No. 6,863,878, the disclosure of which is hereby incorporated by reference. In particular, the carbonaceous material in the devolatilization zone is maintained at a temperature less than 450° F. until all of the available oxygen is reacted. In the present invention, this material is then raised to a temperature of about 1000° F. in the devolatilization zone prior to being combined with steam to form the syn gas in the reformer reactor.

From the reformer reactor, the formed syn gas passes through a series of particulate separators to remove any formed ash. These separators are maintained at a temperature greater than 1500° F., by housing them in the same furnace as the reformer reactor. This prevents unwanted reactions which can occur when the syn gas cools, and avoids carbon buildup in the apparatus. The syn gas from the separator is rapidly quenched to a temperature well below 1000° F., preferably to a temperature of about 120° F. At this temperature, the syn gas is stable and will not form carbon deposits or allow unwanted reactions. At the same time the material is cooled, preferably in a quencher, any residual tar or oil is separated and either fed back to the devolatilization zone for reaction or collected for further use. In a further feature of the present invention, the heat from the devolatilization zone is directed to a preheater section where water and combustion air are circulated to recover residual heat.

The objects and advantages of the present invention will be further appreciated in light of the following detailed description and drawings, in which:

DETAILED DESCRIPTION OF THE INVENTION

Figure 1A:
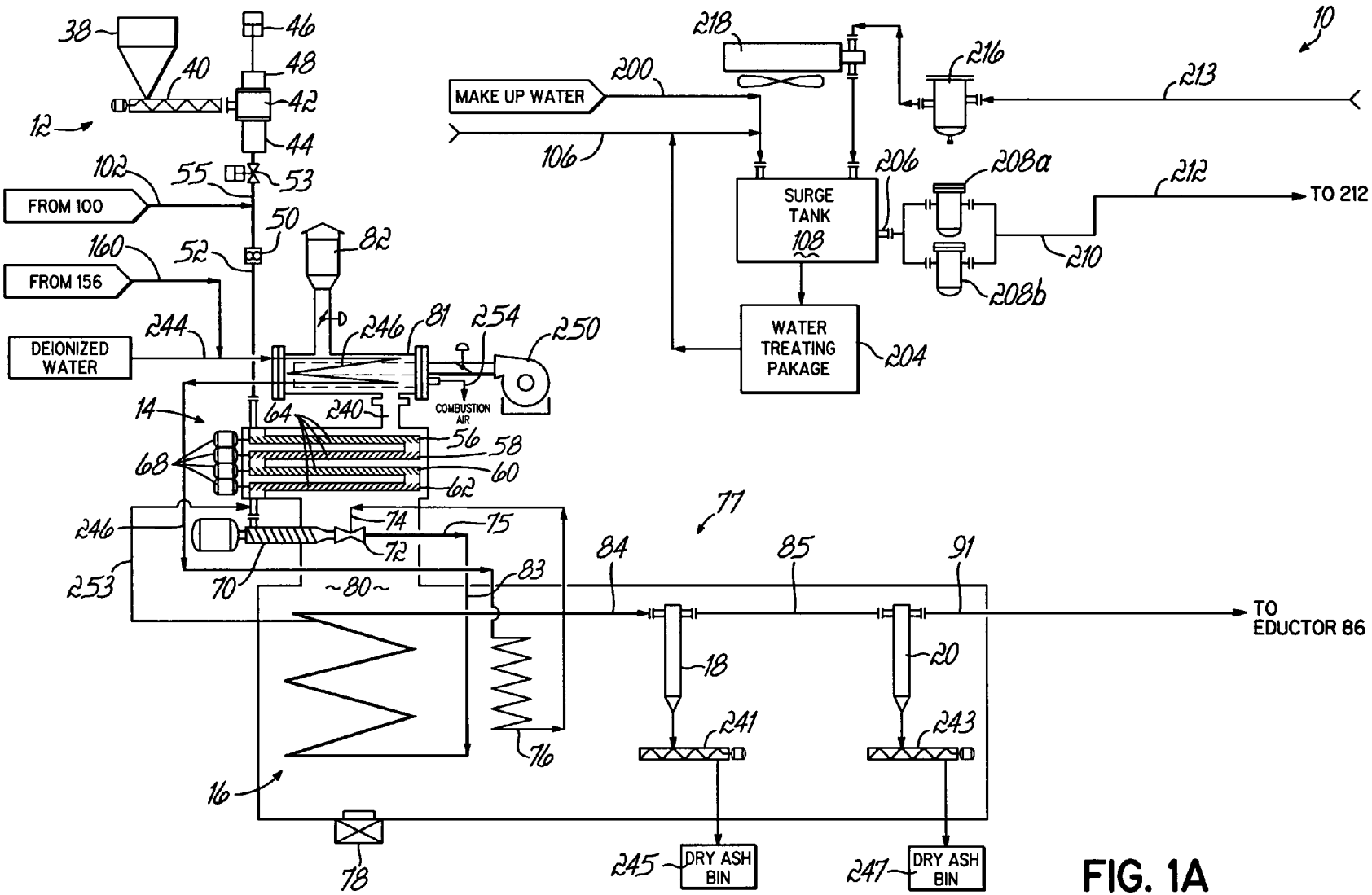
FIGS. 1A and 1B are diagrammatic depictions of the apparatus used in the present invention.
Figure 1B:
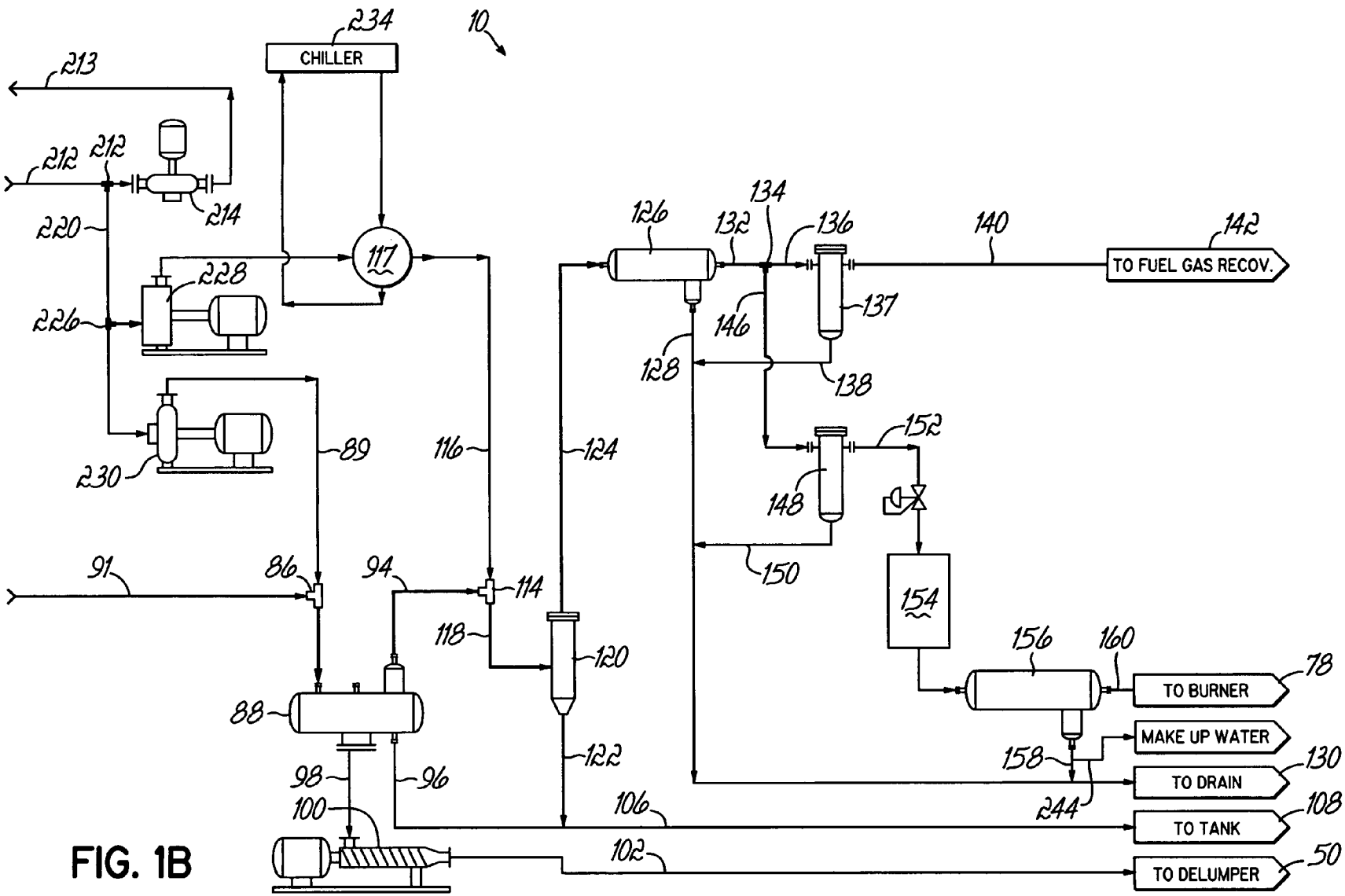

As shown diagrammatically in FIGS. 1A and 1B, syn gas facility 10 includes a feed section 12 which communicates with a devolatilization section 14, in turn connected to a reformer reactor 16. The reactor 16 is designed to produce syn gas which passes through particulate separators 18 and 20. The gas is cooled, filtered, and collected for use.

Figure 2:
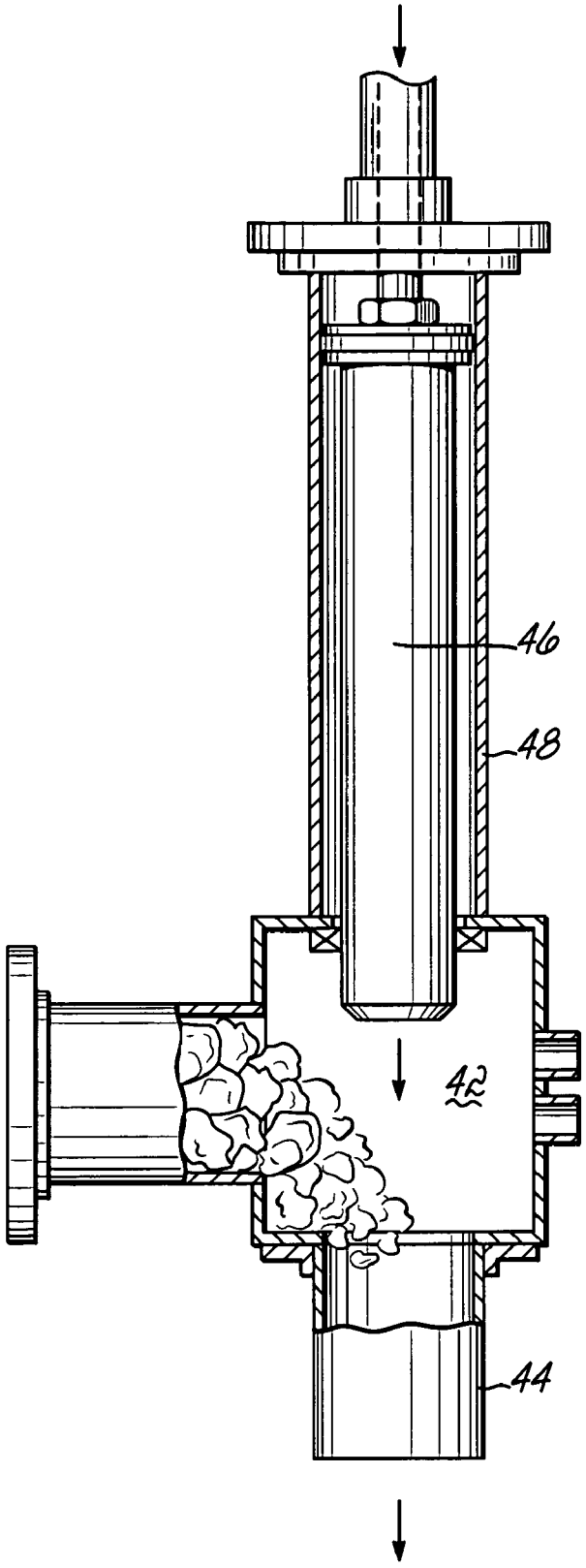
FIG. 2 is a cross sectional view of an embodiment of the feed section.

As shown more particularly in FIGS. 1 and 2, the feed section 12 includes a hopper 38 having an auger 40, which directs cabonaceous feed material to feed chamber 42. The feed chamber 42 is connected to a feed tube 44 which leads to the devolatilization section 14. Above the feed section is a cylindrical support 48 which supports a compacting cylinder 46 designed to force feed material from the feed chamber 42 into the feed tube 44. The feed tube 44 leads to a delumper 50, which communicates via passage 52 to the devolatilization section 14. A gate valve 53 prevents backflow through line 55 from delumper 50.

The devolatilization section 14 includes four cylindrical reaction chambers 56,58,60 and 62. Each reaction chamber is in communication with the next reaction chamber. Each reaction chamber includes an auger 64 which is adapted to force the feed material through the respective chambers 56-62 to feed auger 70. The augers 64, in turn, are operated by motors 68. The feed auger 70 communicates with the feed eductor 72. Steam from a steam heater 76 located in furnace 77 is introduced into an eductor 72 through steam inlet 74. This forces material cycloconically through line 75 to the reactor 16, also located in furnace 77.

The furnace 77 includes a burner 78 and a combustion outlet or plenum 80. In addition to the reactor 16, the furnace includes steam heater 76 and separators 18 and 20. Combustion outlet 80 directs heated air to devolatilization zone 14, which, in turn, communicates with a preheater 81 which ultimately communicates with a stack 82.

As shown, reformer reactor 16 is a tubular reactor which communicates with eductor 72 via line 83. An outlet line 84 from reactor 16 leads to the first particulate separator 18. Separator 18 includes a gas outlet line 85 which, in turn, leads to the second particulate separator 20. Line 91 directs gas from separator 20 to a quench eductor 86 which directs gas and water through line 87 to a quench tank 88 (FIG. 1B). The quench eductor 86 includes a water inlet line 89.

The quench tank 88 is a gas/water/oil separator and includes a gas outlet 94, a water outlet 96 and a tar/oil outlet 98. The tar outlet 98, as shown, leads to a pump 100 which directs tar and/or oil via line 102 to line 55 just upstream of delumper 50. The water outlet 96 is directed through line 106 through a surge tank 108.

The gas outlet 94 in turn leads to a second quencher eductor 114, which includes a water inlet 116 directed from tank 117. The quench eductor outlet 118 in turn leads to a secondary quencher 120. The quencher 120 includes a water outlet 122 and a gas outlet 124, which leads to a quench scrubber 126.

The water outlet 122 leads to water line 106, in turn leading to surge tank 108. The quench scrubber 126 includes a water outlet 128 which goes to a drain 130. The gas outlet 132 from the quench scrubber 126 leads to a T 134 wherein a first line 136 is directed to a water filter 137 which removes water. A gas outlet 140 from filter 137 passes to the product gas section 142, and a water outlet 138 leads via line 128 to drain 130. The second line 146 from T 134 is directed to a second water filter 148 which also includes a water outlet 150 which leads back to the drain 130 via line 128. The gas outlet 152 is directed to a compressor 154 and, in turn, to a scrubber 156 to remove residual water. The scrubber 156 includes a water outlet 158 directed to either the drain or makeup water line 244, and a gas outlet 160 which is, in turn, directed to the burner 78 where it is used to heat the furnace 77.

A make up water inlet 200 leads to the surge tank 108. The water in tank 108 can circulate through an optional water treatment package 204, depending on the particular water conditions, such as hardness and the like.

The tank 108 includes an outlet 206 which is directed to tandem filters 208*a* and 208*b*. The filters have a common outlet 210 which is directed to T 212. One line from T 212 is directed to a first pump 214. Pump 214 directs the water through line 213, a filter 216 and, subsequently, to a cooler 218 which directs chilled water back to tank 108. The second line 220 from T 212 is directed to a second T 226 which directs a portion of water to a second pump 228 which directs it to a tank 117, which, in turn, communicates with a chiller 234. Third pump 230 directs water from T 212 through line 89 into quench eductor 86, as previously described.

The apparatus 10 also includes a preheater section 81 which utilizes exhaust gas that has passed from the furnace 77 through the devolatilization section 14 to preheat water for the steam reactor 16, as well as combustion air for the burner 78. The exhaust from furnace 77 passes through exhaust plenum 80 to devolatilization section 14 and then through exhaust 240 to the preheater section 81. Water inlet line 244 directs deionized water through the preheater section through line 246 to the steam heater 76. A blower 250 is used to introduce air through the preheater 81. This is exhausted via line 254 to burner 78.

In operation, feed, such as pulverized coal, is introduced through hopper 38 and feed section 12 where it is compressed by cylinder 46 and forced through valve 53 and line 55 to the delumper 50. The feed is forced into the devolatilization section 14. Cylinder 46 applies sufficient pressure to compress the feed material and drive out most air associated with the feed material, generally 10-20 psi or greater. This force, overcomes any pressure from the devolatilization section and causes the feed material to act as a seal between the feed section 12 and devolatilization section 14. This removes air from the feed and prevents introduction of unwanted oxygen into the devolatilization zone.

Auger 64 forces the feed through chambers 56-62. The devolatilization section starts with a lower temperature first chamber 56, followed by a higher temperature second chamber 58 and, in turn, a higher temperature third 60 and fourth 64 chamber. The temperatures of the chambers are designed so that the temperature of the feed material does not reach 450° F. until all oxygen in the feed material reacts, in order to prevent pyrolysis. Generally, the first reaction chamber will have an initial temperature of about 100° F., with the final devolatilization section at 1000° F. Most of the free oxygen will react well before the feed reaches a portion of the devolatilization section that is at 450° F. The temperature of each section is controlled by its proximity to exhaust plenum 80 as well as surface area and residence time. The pressure from the feed tube 44 through the devolatilization section 14 is about 125 psig.

The end product exiting from the devolatilization section 14 is primarily char and gases liberated during devolatilization. This end product is directed to the feed auger 70 leading to steam eductor 72. Steam from steam heater 76 is directed into the eductor 72. The temperature of the steam should be about 1500° F. and the pressure is about 125 psi. The eductor then leads to the reformer reactor 16 wherein the syn gas is created. In the reactor 16, the reactor temperature is increased to greater than 1500° F., preferably about 1550° F. at a pressure of about 125 psig. A portion of the reactant flow in reactor 16 can be directed through line 253 to an inlet immediately upstream of feed auger 70 to carry solids at low flow or feed rates.

The reaction product from reactor 16, ash and syn gas, is directed to cyclone separators 18 and 20, which are located within the furnace 77 and maintained at the same temperature of the reactor 16 of about 1550° F. at 125 psi. Separators 18 and 20 remove the ash from the reaction product. The ash is directed to augers 241 and 243 which move the ash into dry ash bins 245 and 247 without permitting syn gas to escape the system.

After passing through separators 18 and 20, the syn gas flows via line 91 from the furnace to quench eductor 86 and quench tank 88 and where it is cooled to about 120° F. by water from tank 108 at about 140 psi. The temperature of the water in tank 108 is controlled by recirculation through cooling tower 218 and is preferably about 90° F. The quench tank 88 separates the gas, water, and oil. The water is directed back to tank 108 and is reused.

The gas itself is then directed from the quench tank 88 to a second quench eductor 114. Water at 200 psi from tank 117 is used to further cool the syn gas to about 70° F. at 125 psi. Chiller 234 is used to establish the water temperature at about 60° F. The cooled gas flows to the secondary quencher 120 which separates water, directing it back to tank 108, and allows the gas to flow to quench scrubber 126, again separating water that is sent through line 128 to the drain from the gas that is directed through filters 137 and 148. The gas from filter 137 is collected for use. The gas from filter 148 is fed back to the burner 78 which fuels the furnace. For initial start up, a separate fuel source can be used.

Figure 4:
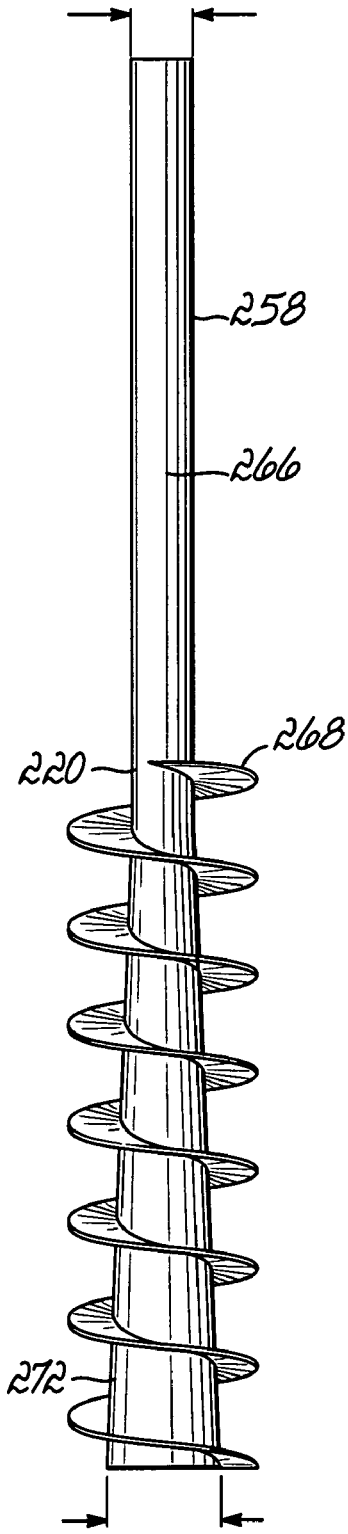
FIG. 4 is a plan view of an auger used in the embodiment shown in FIG. 3.
Figure 3:
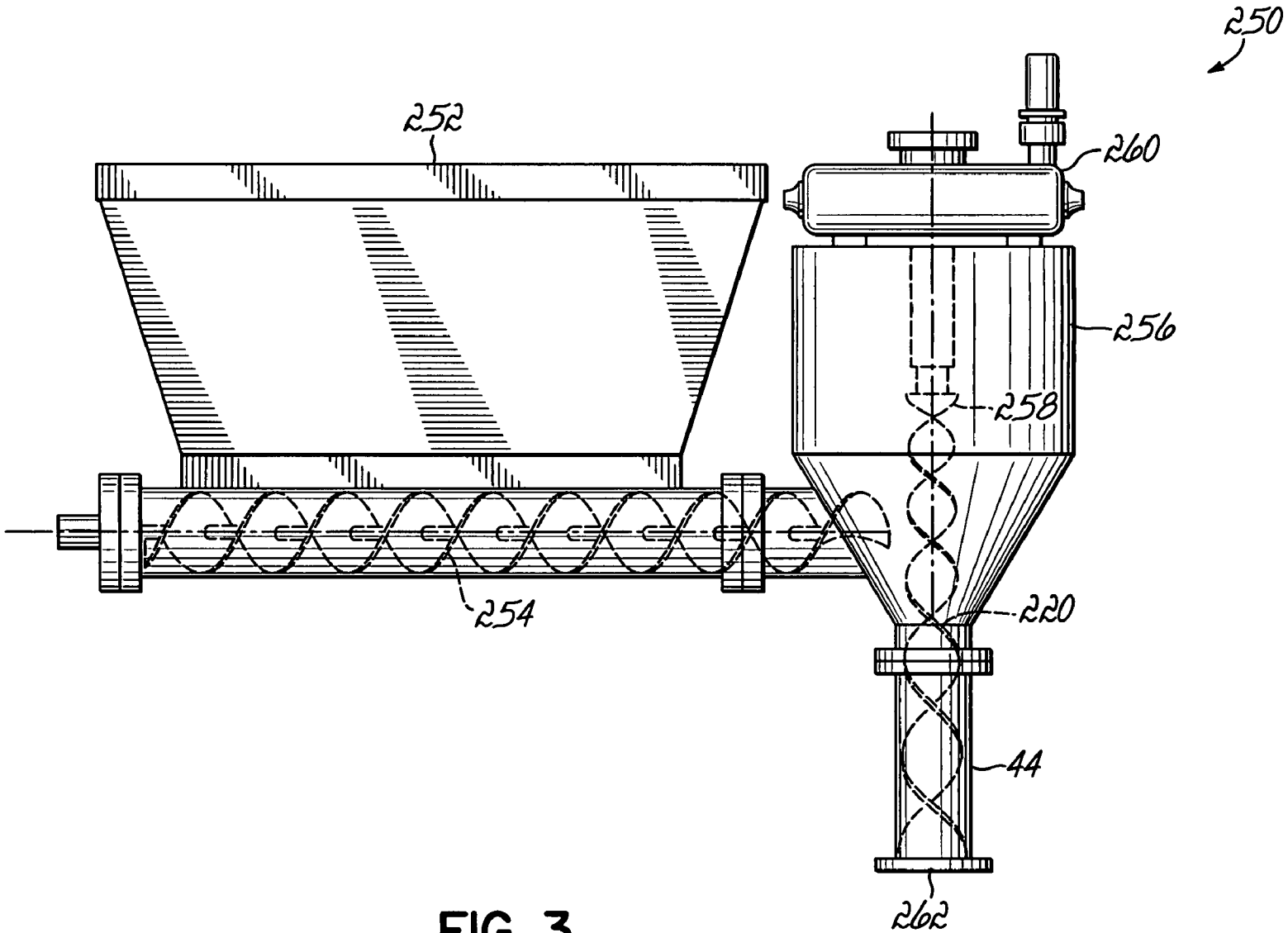
FIG. 3 is a schematic elevational view of an alternate feed section.

An alternate feeder 250 is shown in FIGS. 3 and 4. Feeder 250 includes a material hopper 252 having a feed auger 254 leading to feed bin 256. Feed bin 256 includes a screw 258 rotated by motor 260. The screw leads to feed tube 44 which connects through outlet 262 to the devolatilization section 14.

As shown in FIG. 4, the screw 258 has a main shaft 266 and a helical blade 268. The outer diameter of blade 268 remains constant while the diameter of shaft 266 increases from the inlet portion 220 to the outlet portion 272. This decreases the area between the shaft 266 and inlet tube 44, thereby compressing the feed material as it is forced into apparatus 10. In use, 20-50% preferably 40% compression is preferred.

Thus, the present invention has many different improvements that improve the efficiency of the process disclosed in Klepper U.S. Pat. No. 6,863,878. Compressing the feed drives off unwanted air and forms an inlet seal. Further, heating the material in a devolatilization zone to 1000° F. prior to addition of steam improves the efficiency of the overall reaction and increases the reaction rate. By maintaining the separators in the furnace and maintaining their temperature, unwanted reactions are avoided, and, in particular, carbon deposition on the apparatus is minimized. The rapid quenching of the syn gas reaction product further avoids any unwanted carbon deposition or reaction products.

This has been a description of the present invention along with the preferred method of practicing the present invention. However, the invention itself should only be defined by the appended claims, WHEREIN

I claim:

1. A method of feeding carbonaceous material to a devolatilization reactor comprising introducing said carbonaceous material to a feed zone;

compacting said material 20-50% to drive air from said material and thereby forming a seal between said feed zone and said devolatilization reactor; and forcing said material into said devolatilization reactor;

heating said carbonaceous material in said devolatilization reactor without any added oxygen to form a char and reacting said char with steam to form syn gas.

2. The method claimed in claim 1 wherein compacting said material forms a substantially gas tight seal between said feed zone and said devolatilization reactor.

3. The method claimed in claim 2 further comprising breaking up said compacted material between said gas tight seal and said devolatilization reactor.

4. The method claimed in claim 1 wherein said carbonaceous material is compressed with an auger.

5. The method claimed in claim 1 wherein said carbonaceous material is compressed with a ram.

6. The method claimed in claim 1 wherein said carbonaceous material is compressed to at least 10 psi.

7. The method claimed in claim 6 wherein said carbonaceous material is coal.

8. A method of forming syn gas comprising introducing a carbonaceous feed material into a devolatilization reactor;

heating said carbonaceous feed material in the absence of added oxygen to a first temperature below 450° F. until substantially all oxygen in said feed material is reacted;

subsequently heating said carbonaceous feed material in the absence of oxygen and without the addition of steam to a temperature of at least about 1000° F.;

subsequently adding steam to reaction product from said devolatilization reactor and forcing said reaction product to a reformer reactor, said reformer reactor heated to a reactor temperature to form syn gas.

9. The method claimed in claim 8 wherein heat is provided to said devolatilization reactor from an exhaust from a furnace housing said reformer reactor.

10. The method claimed in claim 9 further comprising directing syn gas to a first particulate separator, maintaining said syn gas in said separator at said reactor temperature.

11. The method claimed in claim 10 further comprising directing syn gas from said separator to a water quencher wherein said syn gas is introduced to said water quencher at said reactor temperature.

12. The method claimed in claim 11 further comprising directing liquid from said quencher to a separator, and separating water and gas, and carbonaceous liquid and tar, from each other directing said carbonaceous liquid and tar to a feed section of said devolatilization reactor.

13. The method claimed in claim 11 wherein said syn gas is cooled to a temperature less than 800° F. in said quencher.

14. The method claimed in claim 11 wherein said syn gas is directed from said first particulate separator to a second particulate separator which is also maintained at said reactor temperature, and wherein gas is directed from said second separator to said quencher.

15. A method of forming syn gas comprising introducing a carbonaceous feed material into a devolatilization reactor;

heating said carbonaceous feed material in the absence of oxygen in said devolatilization reactor;

directing reactant product from said devolatilization reactor to a reformer reactor and mixing steam with said reactant product and heating said product in a furnace to a reactor temperature to form syn gas;

directing said syn gas to a particulate separator located in said furnace wherein said particulate separator is maintained at said reactor temperature;

directing syn gas from said separator to a quencher wherein the temperature of said syn gas is reduced to less than 800° F.

16. The method claimed in claim 15 further comprising directing liquid from said quencher to a separator and separating water, syn gas and carbonaceous liquid material; and directing said carbonaceous liquid material to a feed section of said devolatilization reactor.

17. The method of claim 8 further comprising directing syn gas to a first particulate separator, maintaining said syn gas in said separator at said reactor temperature, wherein said reformer reactor and said first particulate separator are located in a furnace.

* * * * *